United States Patent [19]

Wilson

[11] 4,446,767

[45] May 8, 1984

[54] LOCKING RING STRIPPER PLATE ASSEMBLY

[75] Inventor: Kenneth J. Wilson, Roseville, Minn.

[73] Assignee: Wilson Tool Company, White Bear Lake, Minn.

[21] Appl. No.: 325,650

[22] Filed: Nov. 30, 1981

[51] Int. Cl.[3] ..... B26D 7/18; B21D 45/08

[52] U.S. Cl. ..... 83/136; 83/140; 83/698

[58] Field of Search ..... 83/140, 146, 136, 138, 83/141, 142, 143, 698; 411/516, 517, 518

[56] References Cited

U.S. PATENT DOCUMENTS

| | | | |
|---|---|---|---|
| 1,767,217 | 6/1930 | Kraft | 411/517 X |
| 2,491,128 | 12/1949 | Nelson | 411/517 X |
| 2,580,396 | 1/1952 | Bluth | 411/516 |
| 3,114,280 | 12/1963 | Schott | 83/140 |
| 3,122,383 | 2/1964 | Hirsch | 411/517 X |
| 3,521,911 | 7/1970 | Hanes et al. | 411/517 X |
| 3,595,113 | 7/1971 | Herzog et al. | 83/146 X |

*Primary Examiner*—Frank T. Yost
*Attorney, Agent, or Firm*—James R. Haller

[57] ABSTRACT

A removeable stripper plate assembly. The assembly includes a punch guide sleeve with a stripper plate support means to aid in supporting a stripper plate within and at the end of the punch guide sleeve. A split locking ring having adjacent ends moveable toward and away from each other is received in a groove in the punch guide sleeve, and extends inwardly of the punch guide sleeve to lock the stripper plate in place. Locking means are provided to maintain the spacing between ends of the split locking ring to thereby maintain it in the groove.

7 Claims, 3 Drawing Figures

LOCKING RING STRIPPER PLATE ASSEMBLY

TECHNICAL FIELD

This invention relates generally to punch guide assemblies such as those usable with multiple-station turret punch machines, and more particularly to stripper plate assemblies.

BACKGROUND ART

Multiple-station turret punch machines such as the Amada Lyla series Model 50-50-72 can provide up to 72 different punch stations for use in conjunction with a like number of opposing die surfaces. In such a machine, each punch station includes a punch assembly and a punch guide. Even with the flexibility afforded by a 72-station machine, however, the operator may wish to change some or all of the punch and die combinations from time to time. For instance, the operator may wish to utilize a different tip shape or one of a different size. It is desirable to minimize the time required to so change the punch and die components, and thereby reduce down time for the punch machine.

In the punching operation, after the punch tip enters the worksheet surface, the edge of the cut surface will tend to follow the punch tip as it retracts. As a result, "stripping" occurs; that is, the edges around the punched hole will bear outwardly and necessitate further time consuming finishing operations.

To prevent stripping, the punch guide may be provided with a stripper plate. A stripper plate is a hardened plate having an opening such that a punch tip will fit snugly therethrough but, yet will be able to axially move freely through the opening. In use, the punch guide is oriented with the stripper plate flush against the worksheet surface. Then, when the punch tip retracts from the worksheet, the edges of the worksheet around the punch hole will be prevented by the stripper plate from following the retracting punch tip.

One such punch guide stripper plate configuration incorporates the stripper plate as an integral part of the punch guide itself. Since the size and shape of the stripper plate hole must coincide closely with the punch tip, however, each such punch guide may only be used with one matching punch assembly. Consequently, interchanging punch and die combinations may be inconvenient, since the operator must change not only the die and punch assembly, but the punch guide assembly as well.

Another configuration uses flattened metal clip or the like to retain a removeable stripper plate at the end of a punch guide. This allows the use of a number of different punch tips with each guide, since only the stripper plate need be changed for each new punch tip. These spring clip structures, however, have not provided completely satisfactory performance. Often, the worksheet surface will have a thin coating of oil or other fluid. When the stripper plate meets the worksheet surface, a suction may be created. When this occurs, the stripper plate may be pulled out of place and damage may result to the worksheet and to the stripper plate. Down time may also become a problem. Finally, these clips also tend to weaken with usage, aggravating the above-noted problems.

Another configuration is shown in U.S. Pat. No. 4,092,888 which depicts a punch guide assembly using a resilient, flat retaining ring to hold a removeable stripper plate in place.

And in yet another configuration, U.S. Pat. No. 4,248,111 depicts a punch guide assembly that makes use of stripper plate holding tabs that are formed on clips attached parallel to the primary axis of the punch guide.

DISCLOSURE OF INVENTION

The invention disclosed herein constitutes an improved stripper plate assembly for allowing stripper plates to be easily and securely affixed to and removed to and from an appropriate punch guide sleeve. This invention finds particular applicability with relatively wide punch guide sleeves. The improvement may be manufactured economically, and does not require any special custom-made tools to operate.

The improvement includes generally a punch guide sleeve, a stripper plate, a locking ring and means for maintaining a given diametral expansion of the locking ring.

The punch guide sleeve differs most markedly from existing punch guide sleeves by the provision of a small annularly-shaped groove disposed within the sleeve between the stripper plate end of the sleeve and a stripper plate support shoulder formed therein. This groove serves as a locking ring receiving means and will snugly receive a generally circular, normally uncompressed spring that may be used to lock the stripper plate into the punch guide sleeve.

The stripper plate includes a retaining flange formed proximal its underside that has an exterior diameter somewhat greater than the peripheral dimensions of the main body of the stripper plate. This stripper plate may be disposed within the punch guide sleeve and positioned against the stripper plate support shoulder so that the annular groove located within the sleeve is positioned between the stripper plate receiving end of the sleeve and the retaining flange of the stripper plate.

The locking ring may be of wire and preferably is substantially circular in cross-section. The ring in split to provide two unconnected ends that are positioned adjacent one another. These ends are characterized by small tabs that extend outwardly of the ring and that may be urged together or apart to change the diametral position of the ring. When these two tabs are held together, the locking ring will be diametrally compressed for insertion between the stripper plate and the punch guide sleeve. The two tabs are located within one of many access slots that are formed in the punch guide sleeve.

So positioned, the two tabs may be released, and the locking ring will uncompress and return diametrally nearly or completely to its original diameters the locking ring being received within the annular groove provided in the punch guide sleeve. So disposed, the locking ring will still extend inwardly beyond the inner surface of the punch guide sleeve and will therefore bear against the retaining flange of the stripper plate to lock the stripper plate in place.

To ensure the security of the locking ring in this locking function, locking means for retaining, the locking ring in its expanded diametral position may be provided. For example, a screw or other spacer means may be fastened between the two tabs of the locking ring to urge them apart and to prevent them from coming together, thereby causing the locking ring to remain in an expanded condition and to remain forced into the groove of the punch guide sleeve.

Using this improvement, a stripper plate may easily be inserted and locked into a punch guide sleeve by placing the stripper plate into the sleeve, positioning the locking ring around the stripper plate and into the sleeve groove, and then securing a screw or the like between the two tabs or the locking ring. Removal of the stripper plate can be easily accomplished by reversing the above steps.

BRIEF DESCRIPTION OF DRAWINGS

The advantages of the instant invention will become more obvious upon reference to the following detailed description, and particularly when considered in view of the appended drawings, wherein.

BEST MODE FOR CARRYING OUT THE INVENTION

Figure 1:
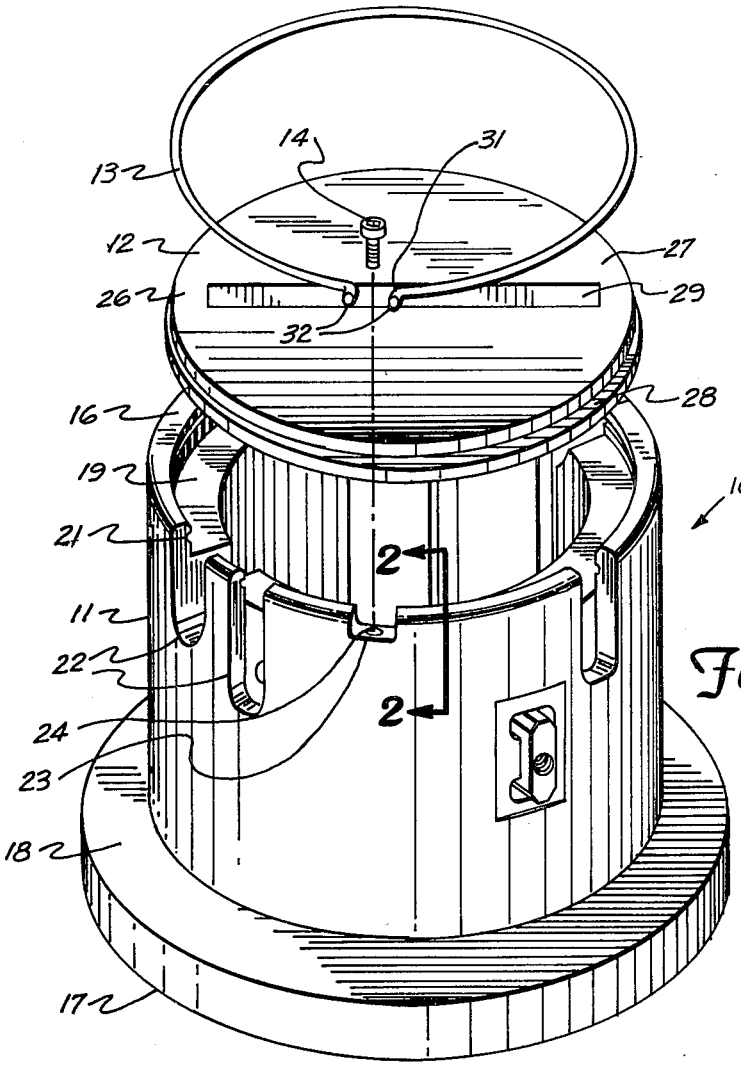
FIG. 1 is an exploded perspective assembly view of the improvement.

Referring now to the drawings, and in particular to FIG. 1, the apparatus of the invention may be seen as depicted generally by the numeral 10. The apparatus (10) includes a punch guide sleeve (11), a stripper plate (12), a locking ring (13) and locking means typified by a locking ring expansion lock (14).

The punch guide sleeve (11) serves the function of guiding a punch drive mechanism (not shown) during the punching process. To make the punch guide sleeve (11) of this invention compatible with such mechanisms, the sleeve includes a first end (16) for receiving a stripper plate (12) and a second end (17) for receiving a punch drive mechanism. The second end (17) also includes a spring support shoulder (18) for use with spring biased punch drive mechanisms.

Figure 2:
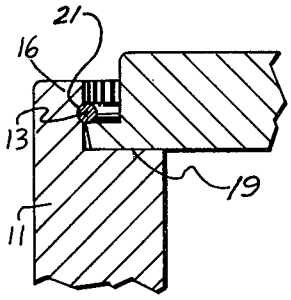
FIG. 2 is a cross-sectional, broken away view taken along line 2—2 of FIG. 1.

Referring to FIG. 2, the bore of the punch guide sleeve (11) includes a stripper plate support shoulder (19) formed annularly about the interior of the sleeve (11) proximal the first end (16). The sleeve (11) also includes a groove (21) disposed annularly about its interior and located between the stripper plate support shoulder (19) and the first end (16) of the sleeve (11).

Referring back to FIG. 1, the sleeve (11) also includes a plurality of various sized access slots (22) formed in the first end (16) thereof. At least one of these access slots (23) may have a threaded opening (24) disposed therein parallel to the axis of the sleeve (11).

The stripper plate (12) may be formed of a disc-shaped plate (26) that has a top side (27) and a bottom side (27.1). A locking ring flange (28) is formed about the plate (26) proximal the bottom side, (27.1), the flange (28) having a larger circumference than the plate (26). The flange (28) is appropriately sized to fit inside the first end (16) of the punch guide sleeve (11) and seat upon the stripper plate support shoulder (19). The stripper plate (12) also includes an opening (29) disposed therethrough for receiving a punch tip (not shown).

The locking ring (13) may be formed of a substantially ring-shaped spring, with both ends (31) of the ring (13) being positioned fairly close to one another at rest. Each end (31) includes a tab (32) extending substantially outwardly of the ring (13).

By urging the two tabs (32) towards each other, the ring (13) will diminish somewhat in peripheral size. Conversely, by urging the two tabs (32) away from each other, the ring (13) will increase in peripheral size.

The size of the locking ring (13) permits it to be compressed (as described above) and thereby made to fit within the punch guide sleeve (11), or alternatively expanded (as described above) and thereby made to assume a peripheral dimension somewhat exceeding the interior dimensions of the punch guide sleeve (11).

The locking ring expansion lock (14) may take the form of a socket cap screw having threads rescrewable in the threaded opening (24) provided in the punch guide sleeve (11). The cap of the screw is sized to fit between the tabs (32) to prevent them from coming together. Other embodiments will be evident to one skilled in the punch machine field.

TO INSTALL THE STRIPPER PLATE

Installation of the stripper plate (12) may be easily accomplished. First, the stripper plate (12) should be seated within the first end (16) of the punch guide sleeve (11) atop the stripper plate support shoulder (19). Next, the two tabs (32) of the locking ring (13) may be urged together so that the locking ring (13) may be axially inserted within the annular space between the punch guide sleeve (11) and the stripper plate (12). Preferably, the locking ring (13) will also be positioned so that the two tabs (32) are located within the access slot (23) that has the threaded opening (24).

Figure 3:
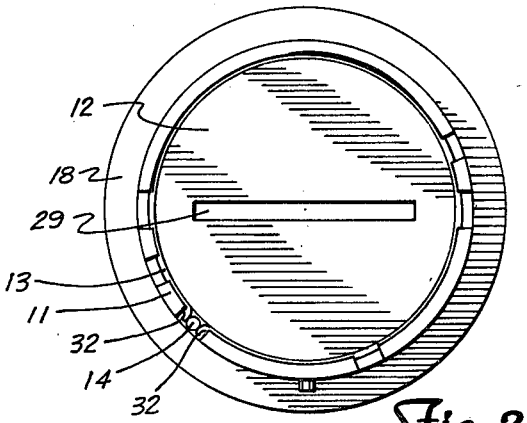
FIG. 3 is a top plan view of the improvement.

The operator then permits the ring (13) to expand somewhat. At the same time, the ring (13) may be guided to come to rest in the groove (21) provided therefore in the sleeve (11). As depicted in FIG. 3, the locking ring (13) will then be partially exposed inwardly beyond the interior surface of the sleeve (11). As a result, the locking ring flange (28) of the stripper plate (12) can not be removed from the sleeve (11) because the locking ring (13) blocks the path of removal.

To ensure that the locking ring (13) remains secure within the groove (21), the locking ring expansion lock (14) may be disposed between the two tabs (32) and connected to the sleeve (11) by use of the threaded opening (24). The cap of the screw will then prevent the locking ring (13) from compressing or from dislodging, as also depicted in FIG. 3.

So installed, the applicant has determined through usage that the stripper plate (12) will not become dislodged during use.

TO REMOVE THE STRIPPER PLATE

Removal of the stripper plate (12) generally entails a simple reversal of the installation procedure.

First, the operator removes the locking ring expansion lock (14). Second, he urges the two tabs (32) together, and removes the locking ring (13) from the groove (21) and from the sleeve (11). Finally, he removes the stripper plate (12).

This improvement finds particular applicability when used in conjunction with relatively wide punch guide sleeves. Such wide sleeves require a wide stripper plate, and typically stripper plate holding mechanisms undergo significant stress in these circumstances. The disclosed improvement, however, measures up well under these circumstances and allows the operator to select wide punch mechanisms without concerning himself that the stripper plate holding mechanism may fatigue and give way.

Other changes and modifications to the disclosed invention may be made without departing from the spirit of the invention or the scope of the appended claims.

What is claimed is:

1. An improved stripper plate assembly for use with a punch guide assembly and comprising (a) A punch guide sleeve having a stripper plate-receiving end, the latter having a stripper plate support shoulder formed annularly within said sleeve and a groove formed annularly within said sleeve adjacent but spaced from said stripper plate support shoulder;

(b) a stripper plate carried within the stripper plate receiving end of the punch guide sleeve and having a peripheral flange disposed between the annularly groove and the annular support shoulder and engaging the annular support shoulder;

(c) a split locking ring of circular cross-section seated in the groove and bearing against the peripheral flange of the stripper plate to lock the latter into position against the annular support shoulder, the split locking ring having adjacent, spaced ends; and (d) removeable spacer means threaded into the punch guide sleeve between the spaced ends of the locking ring to rigidly space apart and maintain the spaced-apart position of such ends.

2. The assembly of claim 1 wherein the adjacent ends of the split locking ring include tabs extending generally radially outwardly, and wherein said locking means comprises a threaded screw threaded into the punch guide sleeve between the tabs of the locking ring, at least a portion of the screw diameter being sized to contact the tabs and to maintain the latter in their spaced-apart position.

3. A removeable stripper plate assembly for use with a punch guide assembly suitable for receiving a punch drive mechanism, and comprising:

(a) a punch guide sleeve having a stripper plate-receiving end, the latter having a stripper plate support shoulder formed annularly within said sleeve and a groove formed annularly within said sleeve adjacent but spaced from said stripper plate support shoulder, the stripper plate-receiving end of the punch guide sleeve having an access slot formed therein;

(b) a stripper plate carried within the stripper plate-receiving end of the punch guide sleeve and having a peripheral flange engaging the annular support shoulder of the punch guide sleeve;

(c) a split locking ring of circular cross-section seated in the groove and bearing against the peripheral flange of the stripper plate to lock the latter in position against the annular support shoulder of the punch guide sleeve, the ends of the locking ring having tabs extending generally radially outwardly within said access slot; and (d) a screw removeably threaded into the punch guide sleeve within said access slot and between the spaced ends of the locking ring to prevent movement of such ends toward one another.

4. A removeable stripper plate assembly comprising a punch guide sleeve having an open stripper plate-receiving end with an access slot formed therein, the sleeve having a stripper plate support shoulder formed annularly therewithin and a groove formed annularly within the sleeve adjacent but spaced from the stripper plate support shoulder, a stripper plate within the punch guide sleeve and having a peripheral flange engaging the support shoulder of the punch guide sleeve, a split locking ring seated within the locking ring groove and bearing against the peripheral flange of the stripper plate to lock the stripper plate into position against annular support shoulder, the split locking ring having adjacent, spaced ends, and removeable spacer means carried by the punch guide sleeve between the spaced ends of the split locking ring and accessible through said access slot for spacing apart the ends of the locking ring to prevent movement of such ends toward one another, said spacer means comprising a screw removeably threaded into the punch guide sleeve within said access slot between the spaced ends of said locking ring.

5. A removeable stripper plate assembly comprising a punch guide sleeve having an open stripper plate-receiving end with an access slot formed therein, the sleeve having a stripper plate support shoulder formed annularly therewithin and a groove formed annularly within the sleeve adjacent but spaced from the stripper plate support shoulder, a stripper plate within the punch guide sleeve and having a peripheral flange engaging the support shoulder of the punch guide sleeve, a split locking ring seated within the locking ring groove and bearing against the peripheral flange of the stripper plate to lock the stripper plate into position against annular support shoulder, the split locking ring having adjacent, spaced ends including tabs extending generally radially outwardly within said access slot, and removeable spacer means carried by the punch guide sleeve between the tabs of the split locking ring and accessible through said access slot to urge the tabs away from one another.

6. The assembly of claim 5 wherein the locking ring is circular in cross-section.

7. A removeable stripper plate assembly comprising a punch guide sleeve having an open stripper plate-receiving end with an access slot formed therein, the sleeve having a stripper plate support shoulder formed annularly therewithin and a groove formed annularly within the sleeve adjacent but spaced from the stripper plate support shoulder, a stripper plate within the punch guide sleeve and having a peripheral flange engaging the support shoulder of the punch guide sleeve, a split locking ring seated within the locking ring groove and bearing against the peripheral flange of the stripper plate to lock the stripper plate into position against annular support shoulder, the split locking ring having adjacent, spaced ends including tabs extending generally radially upwardly within the axis slot, and removeable spacer means carried by the punch guide sleeve and comprising a screw removeably threaded into the punch guide sleeve within the access slot and between the tabs of the locking ring and accessable through said access slot, at least a portion of the screw diameter being sized to contact and to maintain spacing between the tabs.

* * * * *